United States Patent [19]

McCullough

[11] 4,075,421

[45] Feb. 21, 1978

[54] DIRECT CURRENT CABLE WITH RESISTIVITY GRADED INSULATION, AND A METHOD OF TRANSMITTING DIRECT CURRENT ELECTRICAL ENERGY

[75] Inventor: Charles R. McCullough, Scotia, N.Y.

[73] Assignee: General Electric Company, New York, N.Y.

[21] Appl. No.: 643,959

[22] Filed: Dec. 23, 1975

[51] Int. Cl.[2] ..... H01B 7/02

[52] U.S. Cl. ..... 174/120 SC; 174/120 R; 174/120 SR

[58] Field of Search ..... 174/102 SC, 120 R, 120 SC, 174/120 SR, 121 R, 110 PM

[56] References Cited

U.S. PATENT DOCUMENTS

| | | | |
|---|---|---|---|
| 1,458,803 | 6/1923 | Burley | 174/121 R |
| 2,293,677 | 8/1942 | Slayter | 174/102 SC |
| 3,646,248 | 2/1972 | Ling | 174/120 SC |
| 3,793,476 | 2/1974 | Misiura | 174/102 SC |
| 3,852,518 | 12/1974 | Wargotz | 174/110 PM |
| 3,909,507 | 9/1975 | Betts | 174/102 SC |
| 3,925,597 | 12/1975 | Misiura | 174/102 SC |
| 3,987,239 | 10/1976 | Chen | 174/120 R |

OTHER PUBLICATIONS

Buller "Calculation of Electrical Stresses in D.C. Cable Insulation".

IEE Transactions on Power Apparatus & Systems, vol. PAS 86 #10 10/67, pp. 1169–1178.

*Primary Examiner*—E. A. Goldberg.

*Attorney, Agent, or Firm*—R. G. Simkins; P. L. Schlamp; F. L. Neuhauser

[57] ABSTRACT

A cable for the transmission of direct current electricity comprising a multi-layered, resistivity graded polymer insulation, and a method of transmitting direct current electricity therewith.

12 Claims, 1 Drawing Figure

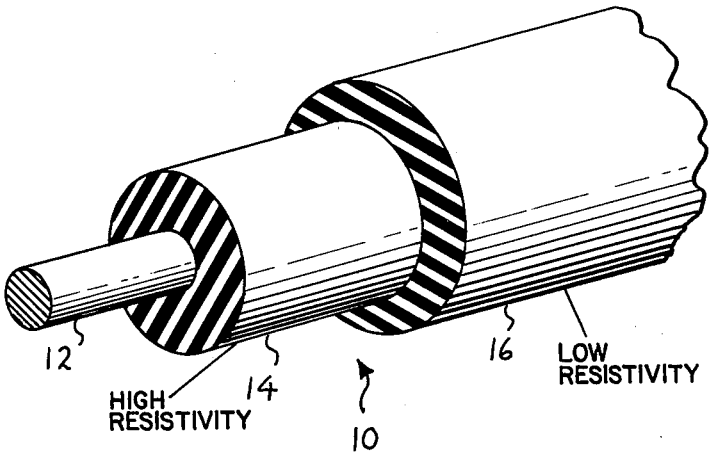
12
HIGH RESISTIVITY
14
10
16
LOW RESISTIVITY

DIRECT CURRENT CABLE WITH RESISTIVITY GRADED INSULATION, AND A METHOD OF TRANSMITTING DIRECT CURRENT ELECTRICAL ENERGY

BACKGROUND OF THE INVENTION

The grading of dielectric insulations for electrical cables for relatively high voltage service comprising the introduction of predetermined gradations of dielectric characteristics in a body or unit of dielectric insulation enclosing an electrical conductor is an old concept and subject in the electrical art. For instance, various aspects and means of grading electrical insulations for cable are proposed and/or disclosed in a paper entitled "Silicone Rubber Graded Construction For High Voltage Insulation," by S. J. Nizinski, published in *Wire and Wire Products,* Volume 3, No. 5, May, 1962, page 628 et seq., and in British Patent 1568 of 1901 and the following U.S. Pat. Nos. 1,802,030; 2,123,746; 2,198,977; 3,160,703; 3,287,489; 3,433,891; 3,711,631 and 3,869,621.

The disclosures and contents of the foregoing publication and patents of the prior art are incorporated herein by reference.

The grading of electrical insulations, as is evident from the foregoing prior art, generally comprises providing an insulation including a series of at least two contiguous sections or areas of different specific inductive capacitance values. An insulation embodying a sequence of different specific inductive capacitance values with the highest specific inductive capacitance closest to the electrical conductor and successively reduced values therefrom, incurs more uniform or evenly distributed electrical stresses or voltage gradients therein when subjected to high voltage alternating electrical current.

However, unlike alternating current electrical systems for cable insulation wherein the maximum degree of electrical stress occurs at the surface of the dielectric insulation adjoining or closest to the conductor carrying the alternating current and progressively diminishes outwardly therefrom, in direct current electrical systems the stress or voltage gradient is distributed resistivity across the thickness of the insulation. Also, distinct from alternating current systems wherein the electrical stresses are nearly independent of temperature conditions, the resistivity of polymeric materials or insulations thereof in direct current transmitting cable is dependent upon temperature, and other conditions including electrical stress or voltage gradient and time. For example, as an electrical cable heats up to operating temperature, or increases in temperature due to external or ambient conditions, the stress conditions across the insulation progressively increase within the outermost regions of the insulation and correspondingly progressively decrease within the innermost regions of insulation adjoining the conductor, whereby the maximum stress exists within the insulation farthest from the electrical conductor and the minimum stress exists within the insulation closest to the conductor. See an article entitled "Electrical Stress Distribution In High Voltage DC Solid Dielectric Cables" by C. R. Mc Cullough, published in IEEE 6866-EI-67.

SUMMARY OF THE INVENTION

This invention comprises electrical cable having resistivity graded insulations for the transmission of direct current electrical energy, and an improved method for transmitting direct current electrical energy. The resistivity graded insulations of this invention are provided by specific combinations of at least two components or layers of certain dielectric polymeric insulating materials which in concert modulate the electrical stress field or voltage gradient passing outwardly therethrough from the conductor, and minimize the disproportional changes in the stress pattern due to temperature differences or other variations in operating conditions such as stress or the voltage gradient and/or time.

OBJECTS OF THE INVENTION

It is a primary object of this invention to provide an improved electrical insulation for cable transmitting direct current electrical energy, and an improved method of transmitting electrical energy through an insulated conductor.

It is also an object of this invention to provide an electrical cable for the transmission of direct current electricity having an insulation which modulates disproportional electrical stress fields or patterns extending out from the electrical conductor through the dielectric insulation under changing temperature and other influencing conditions.

It is a further object of this invention to provide a resistivity graded insulation for direct current electricity transmitting cables which effects a more uniform or even electric field or stress pattern from the conductor outward through the surrounding dielectric insulation over substantially all conditions of service.

It is a still further object of this invention to provide a multi-layered, resistivity graded polymeric insulation having improved dielectric properties for service in direct current electrical energy transmission, and which lowers stress peaks or extremes therein.

It is an additional object of this invention to provide an improved method of transmitting direct current electrical energy through an insulated cable with a more uniform or even electrical field or stress distribution passing out from the electrical conductor through the dielectric insulation regardless of temperature conditions or changes therein.

BRIEF DESCRIPTION OF THE DRAWING

The drawing is a perspective view of a graded cable product of this invention with portions of the multi-layered graded insulation cut away for the purpose of illustration.

DESCRIPTION OF A PREFERRED EMBODIMENT

This invention comprises an electrical cable for the transmission of direct current electrical energy and having a novel and advantageous resistivity graded dielectric insulation thereon, and an improved method of transmitting direct current electricity with a minimum of stress changes within the dielectric insulation.

According to a preferred embodiment of this invention, a resistivity graded dielectric insulation providing improved stress distribution in a direct current electricity transmitting cable is formed of a combination of an inner layer of polymeric insulating material having a relatively high resistivity adjacent to the conductor and a contiguous outer layer of a filled polymeric insulating material having a relatively low resistivity. The inner layer of the said polymeric insulating material of higher resistivity comprises cross-link cured polyethylene, and the outer layer of said filled polymeric insulating material comprises a cross-link cured ethylene-containing polymer selected from the group consisting of polyethylene or copolymers of ethylene and propylene. The filler content for the outer layer of insulation composed of the ethylene-containing polymeric material comprises about 25 up to about 150 parts by weight of the filler per 100 parts by weight of the polymer. Apt fillers include clay and titanium dioxide.

The copolymers of ethylene and propylene for the practice of this invention comprise typical ethylene-propylene copolymer rubbers composed of approximately equal parts by weight of ethylene and propylene. However, they may include copolymers containing substantially greater proportions of ethylene than propylene, and may also include minor amounts of a third monomer.

The cross-link curing of the polymeric materials, or compounds formed thereof, comprising the components of the resistivity graded direct current insulation of this invention, can be effected in a conventional manner employing radiation or free radical forming, organic peroxide cross-linking curing agents such as set forth in U.S. Pat. Nos. 2,888,424; 3,079,370; 3,086,966; and 3,214,422. Specific organic peroxide curing agents include di-cumyl peroxide; 2, 5-dimethyl-2,5 (t-butyl peroxy) hexane; 2, 5-dimethyl-2,5 (t-butyl peroxy) hexyne-3 $\alpha$, $\alpha'$-bis (t-butyl peroxy) diisopropylbenzene, and similar tertiary diperoxides.

The following comprise examples of preferred and typical polymeric insulating composition for the resistivity graded, composite dielectric insulation for direct current electricity transmission service of this invention.

The resistivity graded insulating compositions for Cable Construction I were composed of the following polymeric compositions in relative parts by weight.

| COMPOSITION A (Higher Resistivity) | |
|---|---|
| Ingredients | Parts By Weight |
| Polyethylene | 100.0 |
| Clay Filler | 50.0 |
| Vinyl Silane | 1.50 |
| Titanium Dioxide Pigment | 5.0 |
| Antioxidant, (polydihydrotrimethylquinoline) | 1.75 |
| Di-cumyl Peroxide Curing Agent | 2.85 |

| COMPOSITION B (Lower Resistivity) | |
|---|---|
| Ingredients | Parts By Weight |
| Polyethylene | 100.0 |
| Clay Filler | 50.5 |
| Carbon Black | 5.0 |
| Antioxidant, (polydihydrotrimethylquinoline) | 1.75 |
| Di-cumyl Peroxide Curing Agent | 3.55 |

The foregoing insulating compositions were utilized in the design of a resistivity graded direct current insulation on an electrical conductor according to this invention by forming a composite graded insulation about a 1760 mils in diameter copper cable conductor composed of a surrounding inner covering layer of Composition A about 285 mils in thickness and a contiguous outer enclosing layer of Composition B about 165 mils in thickness. The properties of this resistivity graded Cable Construction I are given in the following table.

The resistivity graded insulating compositions for Cable Construction II were composed of the following compositions in relative parts by weight.

| COMPOSITION C (Higher Resistivity) | |
|---|---|
| Ingredients | Parts By Weight |
| Polyethylene | 100.0 |
| Antioxidant (polydihydrotrimethylquinoline) | 1.0 |
| Di-cumyl Peroxide Curing Agent | 3.5 |

| COMPOSITION D (Lower Resistivity) | |
|---|---|
| Ingredients | Parts By Weight |
| Ethylene-Propylene Rubber Copolymer | 100.0 |
| Clay Filler | 96.0 |
| Vinyl Silane | 1.5 |
| Zinc Oxide | 3.0 |
| Lead Dioxide | 2.0 |
| Petroleum Jelly | 5.0 |
| Antioxidant (polydihydrotrimethylquinoline) | 2.0 |
| Curing Coagent (polybutadienehomopolymer) | 5.0 |
| Di-cumyl Peroxide Curing Agent | 6.0 |

The foregoing insulating compositions were also utilized in the design of a resistivity graded direct current insulation on an electrical conductor according to this invention by forming a composite graded insulation about a 1760 mils in diameter copper cable conductor composed of a surrounding inner covering layer of Composition C about 225 mils in thickness and a contiguous outer enclosing layer of Composition D about 225 mils in thickness. The properties of this resistivity graded Cable Construction II are given in the following table.

The resistivity graded insulating compositions for Cable Construction III were composed of Composition C given above, combined in a composite insulation with the following polymeric composition in relative parts by weight.

| COMPOSITION E (Lower Resistivity) | |
|---|---|
| Ingredients | Parts By Weight |
| Polyethylene | 100.0 |
| Titanium Dioxide Filler | 115.0 |
| Vinyl Silane | 3.45 |
| Antioxidant (polydihydrotrimethylquinoline) | 1.75 |
| Di-cumyl Peroxide Curing Agent | 3.55 |

The foregoing insulating composition and Composition C were utilized in the design of a resistivity graded direct current insulation on an electrical conductor according to this invention by forming a composite graded insulation about a 980 mils in diameter copper cable conductor composed of a surrounding inner covering layer of Composition C of about 123.5 mils in thickness and a contiguous outer enclosing layer of Composition E about 125 mils in thickness. The properties of this resistivity graded Cable Construction III at two different temperature levels are given in the following table.

The table gives peak direct current electrical stresses of single dielectric composition or resistivity insulations in comparison with dual or composite dielectric composition or resistivity graded insulations on the same size electrical conductors as set forth. The electrical stresses were determined after electrification of the test samples for 60 minutes to achieve approximately steady state conditions.

| Cable Size Temp. | Voltage KV | Total Wall Mils | Avg. Stress V/Mil | Single Layer Ins. Comp. Thickness | Single Layer Peak Stress V/Mil | Single Layer Ins. Comp. Thickness | Single Layer Peak Stress V/Mil | Dual Layers Inner Ins. Comp. Thickness | Dual Layers Outer Ins. Comp. Thickness | Peak Stress For Dual Ins. | Volts/Mil * Reduction | Percent Reduction |
|---|---|---|---|---|---|---|---|---|---|---|---|---|
| 500MCM ΔT=90−54 =36° C | 300 | 450 | 667 | A 450 | 757 | B 450 | 870 | A 285 | B 165 | 725 | 32 | 4.23 |
| 500MCM ΔT=90−54 =36° C | 300 | 450 | 667 | C 450 | 865 | D 450 | 878 | C 225 | D 225 | 768 | 97 | 11.2 |
| 2/0 ΔT=90−54 =36° C | 50 | 248.5 | 201.2 | C 248.5 | 347 | E 248.5 | 282 | C 123.5 | E 125 | 264 | 18 | 6.38 |
| 2/0 ΔT=90−13 =77° C | 50 | 248.5 | 201.2 | C 248.5 | 568 | E 248.5 | 442 | C 123.5 | E 125 | 384 | 58 | 13.1 |

* Stress difference between the lower single insulation cable, peak stress and dual insulation cable peak stress.

As is apparent from the data of the examples set forth in the table, the calculated extent of peak stress reduction resulting from the resistivity grading of insulations in direct current service ranges from about 4.2% to about 13.1%. A comparison shows that the Compositions A and B systems has a peak stress of about 725 volts per mil and Compositions C and D systems with the same 500 MCM cable geometry and voltage has a peak stress of about 768 volts per mil. The peak stresses for the Compositions C and E systems are about 264 volts per mil and about 384 volts per mil at the two temperature levels given, and the advantage of resistivity grading for direct current service is increased from about 6.4% to about 13% when the temperature increases from about 36° C to about 77° C.

The drawing illustrates a typical direct current electrical energy transmitting cable construction for the practice of this invention. The direct current, resistivity graded electrical cable 10 of this invention comprises a central elongated electrical conductor 12 composed of a metal of high electrical conductivity such as copper or aluminum, which may be either a single rod as shown or multiple strands. Enclosing the conductor 12 is a composite resistivity graded dielectric insulation including an inner surrounding layer of polymeric dielectric insulation 14 of relatively high resistivity closest to the conductor, and an overlying contiguous or adjoining outer layer of filled polymeric dielectric insulation 16 of relatively low resistivity.

As should be apparent from the foregoing, the advantages of this invention can be achieved by constructing a direct current transmitting cable with two or more layers or components or dielectric insulating material having different resistivities in the manner prescribed herein.

Although the invention has been described with reference to certain specific embodiments thereof, numerous modifications are possible and it is desired to cover all modifications falling within the spirit and scope of the invention.

What I claim as new and desire to secure by Letters Patent of the U.S. is:

1. An electrical cable for the transmission of high voltage direct current electrical energy which minimizes disproportional direct current induced electrical stresses through the insulation due to temperature changes comprising an elongated metal electrical conductor enclosed within a resistivity graded, composite body of polymeric dielectric insulation, said composite dielectric insulation comprising the combination of an inner layer of polymeric insulation of relatively high resistivity and a contiguous outer layer of filled polymeric insulation of relatively low resistivity, the inner layer of the polymeric insulation comprising a polymeric material consisting essentially of cross-linked polyethylene and the outer layer of the filled polymeric insulation consisting essentially of cross-linked ethylene-containing polymer selected from the group consisting of polyethylene and copolymers of ethylene and propylene containing about 25 to about 150 parts by weight of at least one filler selected from the group consisting of clay and titanium dioxide per 100 parts by weight of the ethylene-containing polymer.

2. The electrical cable of claim 1, wherein the cross-linked polyethylene of the inner layer contains up to about 75 parts by weight of clay filler per 100 parts by weight of the polyethylene.

3. An electrical cable for the transmission of high voltage direct current electrical energy which minimizes disproportional direct current induced electrical stresses through the insulation due to temperature changes comprising an elongated metal electrical conductor enclosed within a resistivity graded, composite body of polymeric dielectric insulation, said composite dielectric insulation comprising the combination of an inner layer of polymeric insulation of relatively low resistivity, the inner layer of the polymeric insulation being composed of cross-linked polyethylene containing about 50 parts by weight of clay filler per 100 parts by weight of the polyethylene and the contiguous outer layer of the polymeric insulation being composed of cross-linked polyethylene containing about 50 parts by weight of clay filler and about 5 parts by weight of carbon black per 100 parts by weight of the polyethylene.

4. An electrical cable for the transmission of high voltage direct current electrical energy which minimizes disproportional direct current induced electrical stresses through the insulation due to temperature changes comprising an elongated metal conductor enclosed within a resistivity graded, composite body of polymeric dielectric insulation, said composite dielectric insulation comprising the combination of an inner layer of polymeric insulation of relatively high resistivity and a contiguous outer layer of polymeric insulation of relatively low resistivity, the inner layer of the polymeric insulation being composed of cross-linked polyethylene and said contiguous outer layer of polymeric insulation being composed of cross-linked ethylene-propylene copolymer containing about 96 parts by weight of clay filler per 100 parts by weight of the copolymer.

5. An improved method of transmitting high voltage direct current electrical energy with an insulated conductor which minimizes disproportional direct current induced electrical stresses through the insulation due to temperature changes, comprising providing an elongated metal electrical conductor enclosed within a resistivity graded, composite body of polymeric dielectric insulation composed of the combination of an inner layer of polymeric insulation of relatively high resistivity and a contiguous outer layer of filled polymeric insulation of relatively low resistivity, said inner layer of polymeric insulation comprising a polymeric material consisting essentially of cross-linked polyethylene and said outer layer of filled polymeric insulation consisting essentially of cross-linked ethylene-containing polymer selected from the group consisting of polyethylene and copolymers of ethylene and propylene containing about 25 to about 150 parts by weight of at least one filler selected from the group consisting of clay and titanium dioxide per 100 parts by weight of the polymer, and transmitting direct current electricity through said insulated conductor.

6. The method of claim 5, wherein the cross-linked polyethylene of the inner layer contains up to about 75 parts by weight of clay filler per 100 parts by weight of the polyethylene.

7. The method of claim 5, wherein the outer layer of filled polymeric insulation comprises clay filler in amount of about 50 to about 96 parts by weight per 100 parts by weight of the polymer.

8. The method of claim 5, wherein the outer layer of filled polymeric insulation comprises titanium dioxide filler in amount of about 115 parts by weight per 100 parts by weight of the polymer.

9. An improved method for transmitting high voltage direct current electrical energy with an insulated conductor which minimizes disproportional direct current induced electrical stresses through the insulation due to temperature changes, comprising providing an elongated metal electrical conductor enclosed within a resistivity graded, composite body of polymeric dielectric insulation comprising the combination of an inner layer of polymeric insulation of relatively high resistivity and a contiguous outer layer of polymeric insulation of relatively low resistivity, said inner layer of polymeric insulation being composed of cross-linked polyethylene containing about 50 parts by weight of clay filler per 100 parts by weight of the polyethylene and said contiguous outer layer of polymeric insulation being composed of cross-linked polyethylene containing about 50 parts by weight of clay filler and about 5 parts by weight of carbon black per 100 parts by weight of the polyethylene, and transmitting direct current electricity through said insulated conductor.

10. An improved method of transmitting high voltage direct current electrical energy with an insulated conductor which minimizes disproportional direct current induced electrical stresses through the insulation due to temperature changes, comprising providing an elongated electrical conductor enclosed within a resistivity graded, composite body of polymeric dielectric insulation comprising the combination of an inner layer of polymeric insulation of relatively high resistivity and a contiguous outer layer of polymeric insulation of relatively low resistivity, said inner layer of polymeric insulation being composed of cross-linked polyethylene and said contiguous outer layer of polymeric insulation being composed of cross-linked ethylene-propylene copolymer containing about 96 parts by weight of clay filler per 100 parts by weight of the copolymer, and transmitting direct current electricity through said insulated conductor.

11. An improved method of transmitting high voltage direct current electrical energy with an insulated conductor which minimizes disproportional direct current induced electrical stresses through the insulation due to temperature changes, comprising providing an elongated electrical conductor enclosed within a resistivity graded, composite body of polymeric dielectric insulation comprising the combination of an inner layer of polymeric insulation of relatively high resistivity and a contiguous outer layer of filled polymeric insulation of relatively low resistivity, said inner layer of polymeric insulation being composed of cross-linked polyethylene and said outer layer of polymeric insulation being composed of cross-linked polyethylene containing about 115 parts by weight of titanium dioxide filler per 100 parts by weight of the polyethylene, and transmitting direct current electricity through said insulated conductor.

12. An improved method of transmitting high voltage direct current electrical energy with an insulated conductor which minimizes disproportional direct current induced electrical stresses through the insulation due to temperature changes, comprising providing an elongated metal electrical conductor enclosed within a resistivity graded, composite body of polymeric insulation composed of the combination of an inner layer of polymeric insulation of relatively high resistivity and a contiguous outer layer of polymeric insulation of relatively low resistivity said inner layer of polymeric insulation consisting essentially of cross-linked polyethylene and said contiguous outer layer of polymeric insulation consisting essentially of cross-linked ethylene-propylene rubber containing about 96 parts by weight of clay filler per 100 parts by weight of the ethylene-propylene rubber, and transmitting direct current electricity through said insulated conductor.

* * * * *